US005572801A

United States Patent [19]

Ahokas et al.

[11] Patent Number: 5,572,801

[45] Date of Patent: Nov. 12, 1996

[54] DRYER SECTION FOR A PAPER MACHINE

[75] Inventors: Matti Ahokas, Jyskä ; Risto Lehosvuo, Säynätsalo, both of Finland

[73] Assignee: Valmet Corporation, Helsinki, Finland

[21] Appl. No.: 457,878

[22] Filed: Jun. 1, 1995

[30] Foreign Application Priority Data

Jun. 14, 1994 [FI] Finland ..... 942811

[51] Int. Cl.[6] ..... F26B 5/04

[52] U.S. Cl. ..... 34/117; 34/116

[58] Field of Search ..... 34/116, 117

[56] References Cited

U.S. PATENT DOCUMENTS

| | | | |
|---|---|---|---|
| 1,017,349 | 2/1912 | Tracy | 34/116 |
| 1,760,923 | 6/1930 | Vedder | 34/117 |
| 3,077,673 | 2/1963 | Cohen et al. | 34/116 |
| 3,315,370 | 4/1967 | Hikosaka | 34/116 |
| 3,868,780 | 3/1975 | Soininen et al. | 34/117 |
| 4,483,083 | 11/1984 | Chance | 34/116 |
| 4,972,608 | 11/1990 | Ilvespaa | 34/115 |
| 5,022,163 | 6/1991 | Ilvespaa et al. | 34/23 |
| 5,062,216 | 11/1991 | Hannigan | 34/117 |
| 5,177,880 | 1/1983 | Preisetanz et al. | 34/117 |
| 5,283,960 | 2/1994 | Sims et al. | 34/116 |

FOREIGN PATENT DOCUMENTS

| | | |
|---|---|---|
| 383744 | 8/1990 | European Pat. Off. . |
| 0428768 | 5/1991 | European Pat. Off. . |
| 4041403 | 6/1992 | Germany . |

*Primary Examiner*—Henry A. Bennett
*Assistant Examiner*—Dinnatia Doster
*Attorney, Agent, or Firm*—Steinberg, Raskin & Davidson P.C.

[57] ABSTRACT

A dryer section for a paper machine including dryer groups with single-wire draw, each of which includes drying cylinders, reversing cylinders or rolls arranged in gaps between the drying cylinders, and a drying wire for carrying the web under constant contact with the wire over the drying cylinders and reversing cylinders or rolls so that the web enters into direct contact with the drying cylinders and that the wire enters into direct contact with the reversing cylinders or rolls. In at least one of the groups with single-wire draw in the dryer section, four drying cylinders are placed in pairs side by side and one above the other so that the upper pair of cylinders is placed at a lower level than the other cylinders in the group.

17 Claims, 7 Drawing Sheets

DRYER SECTION FOR A PAPER MACHINE

BACKGROUND OF THE INVENTION

The present invention relates to a dryer section for a paper machine which comprises at least dryer groups provided with single-wire draw. Each of the single-wire draw groups comprises a number of drying cylinders and a number of reversing cylinders or rolls arranged in the gaps between the drying cylinders. In each of the dryer groups, a web runs under constant contact with the wire over the drying cylinders and reversing cylinders or rolls so that the web enters into direct contact with the drying cylinders and the wire enters into direct contact with the reversing cylinders or rolls.

Currently the highest web speeds in paper machines are of an order of about 25 meters per second, but before long the speed range of from about 25 m/s to about 40 m/s is also likely to be realized. With the current highest speeds and with the future still higher speeds, in particular the dryer section has become and will be a bottle-neck for the runnability of a paper machine. With a view toward obtaining an adequate drying efficiency, the dryer section has often become long, which increases the costs of the dryer section and of the machine hall.

In the prior art, in multi-cylinder dryers of paper machines, twin-wire draw and/or single-wire draw is/are employed. In the former case, the groups of drying cylinders comprise two wires which press the web, one from above and the other one from below, against the heated cylinder faces of the drying cylinders. Between the rows of cylinders, which are usually horizontal rows, the web has free and unsupported draws which are susceptible of fluttering and which may result in web breaks. In the single-wire draw, each group of drying cylinders comprises a single drying wire on whose support the web runs through the whole group so that, on the drying cylinders, the drying wire presses the web against the heated cylinder faces, and on the reversing cylinders between the drying cylinders the web remains at the side of the outside curve, i.e., the drying wire is between the web and the outer surface of the reversing cylinders. Thus, in single-wire draw, the drying cylinders are placed outside the wire loop, and the reversing cylinders inside the loop. In the prior art normal groups with single-wire draw, the heated drying cylinders are placed in an upper row, and the reversing cylinders are placed in a lower row, the rows being generally horizontal and parallel to one another. So-called inverted groups with single-wire draw are also known, in which the heated drying cylinders are placed in the lower row and the reversing suction cylinders or rolls in the upper row, the substantial objective of an inverted group being to dry the web from the side opposite in relation to a normal group with single-wire draw.

In the area of the dryer section of a paper machine, various problems have occurred, of which in particular the large length of the dryer section should be mentioned. With respect to the prior art related to this, reference is made to U.S. Pat. No. 5,177,880, in which a dryer section of a paper machine is described which has been divided into a number of dryer groups, each of which groups comprises a number of drying cylinders, a number of reversing cylinders in the gaps between the adjacent cylinders, and a web support belt which runs around the cylinders in the dryer group. In each dryer group, the web runs under constant contact with the support belt over the drying cylinders and the reversing rolls so that the web enters into direct contact with the cylinders and that the support belt enters into direct contact with the reversing rolls. The cylinders are arranged in a number of rows, which rows are inclined in relation to the vertical direction alternatively rearward or forwards, thus defining V-shaped double rows. The cylinder placed at the end of each row and the cylinder placed at the beginning of the next row form a pair of cylinders, which cylinders are arranged horizontally side by side. The drying cylinders follow each other as a zig-zag line. Each inclined row comprises about three cylinders.

In the prior art, constructions are also known in which the cylinders are placed in vertical rows. One such construction is described in U.S. Pat. No. 4,972,608.

OBJECTS AND SUMMARY OF THE INVENTION

It is an object of the present invention to provide a dryer section of a paper machine whose length is shorter than existing dryer sections.

It is a further, particular object of the invention to provide a dryer section construction that is suitable for use in connection with modernizations of dryer sections of paper machines.

In view of achieving the objects stated above and others, the dryer section of a paper machine in accordance with the invention comprises groups with single-wire draw in the dryer section having at least four drying cylinders placed in pairs side by side and one above the other so that the upper pair of cylinders is placed at a lower level than the other cylinders in the group. As an important advantage of the present invention, a shorter length of the dryer section is achieved, in which case, for example in connection with modernizations of paper machines, as a result of the shorter length, in the space that remains in the final end of the dryer section, for example, a surface-sizing device and/or an afterdryer can be placed, whereby the quality of the paper produced can be improved. On the other hand, when new paper machines are constructed, by means of the shorter length of the dryer section, considerable economies are obtained as a result of the economies in the costs of the machine hall.

In a basic embodiment, the dryer section for a paper machine in accordance with the invention comprises a plurality of dryer groups with single-wire draw, each of the single-wire draw groups including drying cylinders, reversing cylinders arranged in gaps between adjacent ones of the drying cylinders, and a drying wire for carrying a web into direct contact with outer surfaces of the drying cylinders and such that the drying wire is situated between the web and outer surfaces of the reversing cylinders. At least one of the single-wire draw groups comprises at least four drying cylinders, first and second ones of the cylinders are arranged in a first horizontal level and third and fourth ones of the cylinders are arranged in a second horizontal level above the first horizontal level such that the axes of the first and third cylinders are situated in a first common substantially vertical column and the axes of the second and fourth cylinders are situated in a second common substantially vertical column, and at least one additional drying cylinder arranged at a horizontal level above the second horizontal level.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
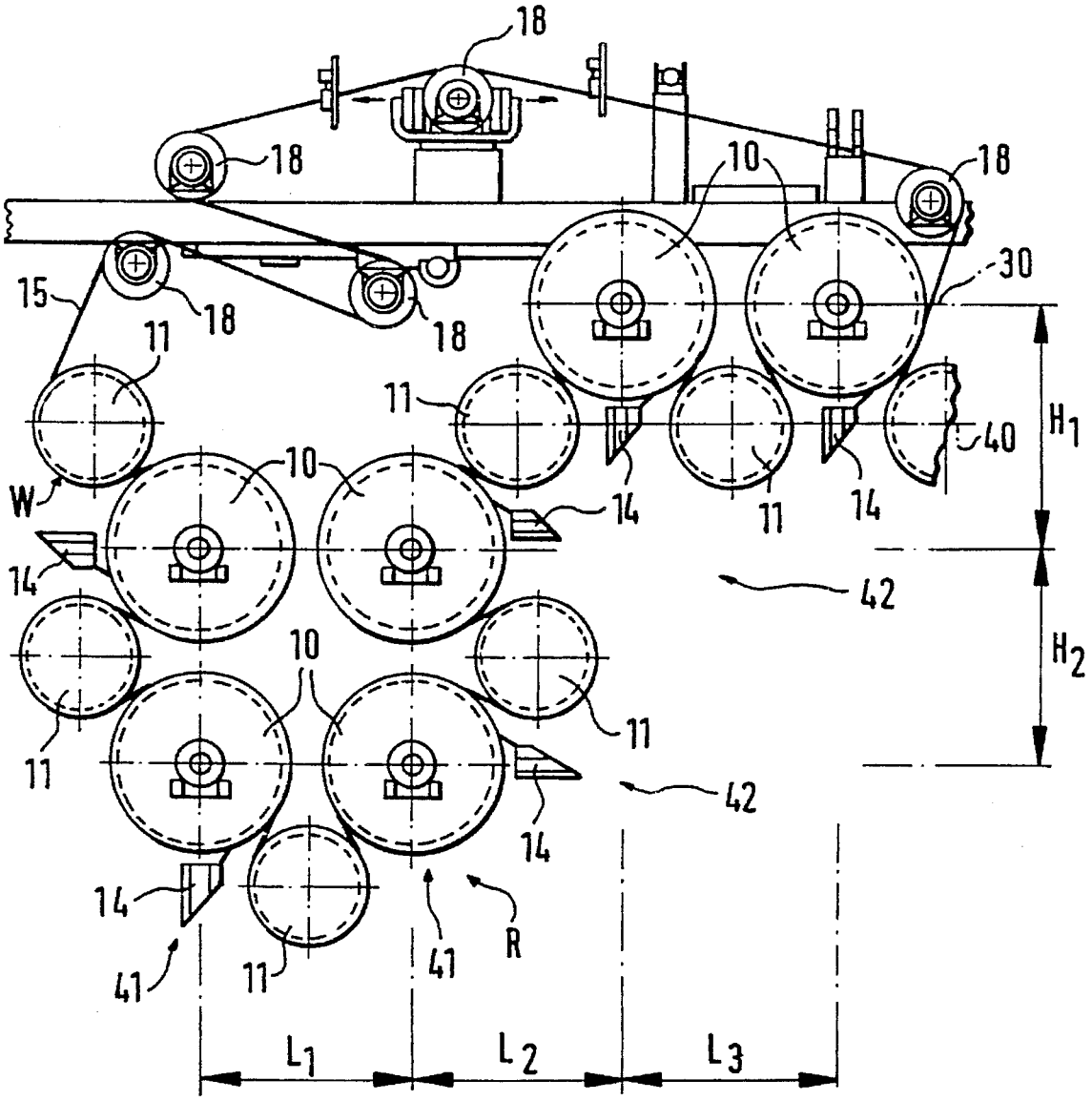
FIG. 1 is a schematic illustration of a construction of a dryer group used in a dryer section in accordance with the present invention.

Referring to the accompanying drawings wherein the same reference numerals refer to the same or similar elements, in accordance with the invention, a dryer group R comprises drying cylinders 10, reversing rolls 11, and a drying wire 15 which is guided by guide rolls 18. In the groups R, if necessary, it is also possible to employ blow boxes 16 in the gaps between the reversing cylinders 11. By means of the blow boxes 16, the intermediate spaces are air conditioned and evaporation from the web W is promoted. The faces of the drying cylinders 10 are kept clean by doctors 14. The drying wires 15 press the web W to be dried on the drying cylinders 10 against their smooth heated faces, and on the reversing cylinders 11, the web W remains at the side of the outside curve on the outer face of the wire 15. On the reversing cylinders 11, the web W is kept reliably on support of the wire 15 against the effects of centrifugal forces by the effect of the vacuum present in the grooved face of the reversing cylinders 11, whereby transverse shrinkage of the web W is also counteracted. As the reversing suction cylinders 11, preferably the suction cylinders marketed by the assignee under the trade mark "VAC-ROLL"™ are used, which have no inside suction boxes and with respect to the details of whose constructions reference is made to the assignee's U.S. Pat. No. 5,022,163, the specification of which is hereby incorporated by reference herein. However, it should be emphasized that the scope of the invention also includes dryer sections in which, in the positions of the reversing cylinders 11, conventional suction rolls provided with inside suction boxes and suction rolls of quite small diameters are employed.

In the dryer groups R in accordance with the present invention, underneath a tending platform 40, four drying cylinders 10 are placed in pairs in two vertical rows or columns, i.e., two cylinders placed one above the other such that their axes are in a substantially common vertical plane and two cylinders placed side by side in a substantially common horizontal plane. The four drying cylinders 10 below the tending platform 40 are placed so that their centers of rotation are placed at the corner points of a rectangle, preferably a square. The reversing cylinders or rolls 11 are placed in the gaps between adjacent pairs of drying cylinders 10 outside the rectangle. The portion consisting of the four drying cylinders 10 placed below may be placed in the beginning, around the middle, or in the end of the dryer group R. As shown, in the dryer groups R, at least one drying cylinder 10 is placed substantially at the level of the tending platform 40.

In the dryer group R as shown in FIG. 1, the first two drying cylinders 10 in the group R are placed one above the other in a vertical row 41, which is placed below the tending platform 40, and the following two drying cylinders 10 are placed at the side of the preceding two drying cylinders on corresponding horizontal levels 42, and the last two drying cylinders 10 in the group R are on the tending platform 40 side by side in the same horizontal plane. The difference in height $H_1$ between the center axes of the cylinders 10 on the tending platform 40 and the two cylinders 10 placed in the next lower plane is from about 1.5 m to about 3.5 m, preferably from about 2.2 m to about 3.0 m, and the difference in height $H_2$ between the axes of the cylinders 10 in the two lowest rows or levels 42 is from about 1.6 m to about 2.7 m, preferably from about 1.9 m to about 2.5 m. The distances between the cylinders 10 are $L_1$ is from about 1.6 m to about 2.7 m, preferably from about 1.9 m to about 2.5 m, $L_2$ is from about 1.2 m to about 2.7 m, preferably from about 1.6 m to about 2.4, and $L_3$ is from about 1.6 m to about 2.7 m, preferably from about 1.9 m to about 2.5 m. The diameter of the cylinders 10 is from about 1500 mm to about 2500 mm, preferably from about 1800 mm to about 2200 mm, and as the reversing cylinders 11, for example, Vac Rolls or suction rolls are used whose diameter is from about 600 mm to about 1800 mm, preferably from about 1200 mm to about 1500 mm. As shown in the figure, the cylinders 10 placed underneath the tending platform 40 are placed in pairs one below the other, in which case a favorable frame solution is obtained (See FIG. 8 in this regard). Further, the rubbish or broke coming from the doctors 14 of the cylinders 10 is directed away by means of a guide blowing or a guide plate (not shown). The drying wire 15 guides the paper web W over the reversing cylinder 11 onto the first drying cylinder 10 in the group R, from which the web W is passed to the cylinders 10 placed side by side in the lowest row 42. The web W is transferred from the last cylinder in the group R to the wire draw of the next group as a closed draw.

In this exemplifying embodiment of the invention, the last two cylinders 10, which are driven cylinders, are placed on the tending platform 40, and thus substantially at the level thereof, which permits a direct application of a drive arrangement which has been found to be good even at high speeds, in which the last two cylinders have a joint drive, auxiliary drive, by means of a suction roll placed between them or ahead of them. The placing of the drives on the tending platform is a construction which is quite favorable in view of the costs and of servicing.

With this exemplifying embodiment of the invention, compared with a conventional single-wire group, the length of the dryer group can be made about 30% shorter.

According to FIG. 2, the first four drying cylinders 10 in the dryer group R are placed, similarly to the exemplifying embodiment shown above in FIG. 1, below the tending platform 40 in pairs one below the other, and the last cylinder 10 in the group R is placed on the tending platform. From the last drying cylinder 10 in the group, the paper web W is passed to the wire draw of the next wire group R as a closed draw. The differences in height and distance between the rows 42/41 of cylinders are as follows: $H_1$ is from about 1.5 m to about 3.5 m, preferably from about 2.2 m to about 3.0 m, $H_2$ is from about 1.6 m to about 2.7 m, preferably from about 1.9 m to about 2.5 m, $L_1$ is from about 1.6 m to about 2.7 m, preferably from about 1.9 m to about 2.5 m, and $L_2$ is from about 1.2 m to about 2.7 m, preferably from about 1.6 m to about 2.4 m. The diameter of the cylinders 10 is from about 1500 mm to about 2500 mm, preferably from about 1800 mm to about 2200 mm, the diameter of the reversing cylinders 11 is from about 600 mm to about 1800 mm, preferably from about 1200 mm to about 1500 mm. In this exemplifying embodiment, the four "downstairs" cylinders 10 below the tending platform 40 are placed in pairs one below the other, and there is just one cylinder 10 on the tending platform 40, and which is the last drying cylinder in the dryer group. In this manner, a group R of five cylinders 10 is formed, which is particularly advantageous in the initial end of the dryer section, where traditionally fewer cylinders are used in the same drive group in order to secure the runnability.

Figure 2:
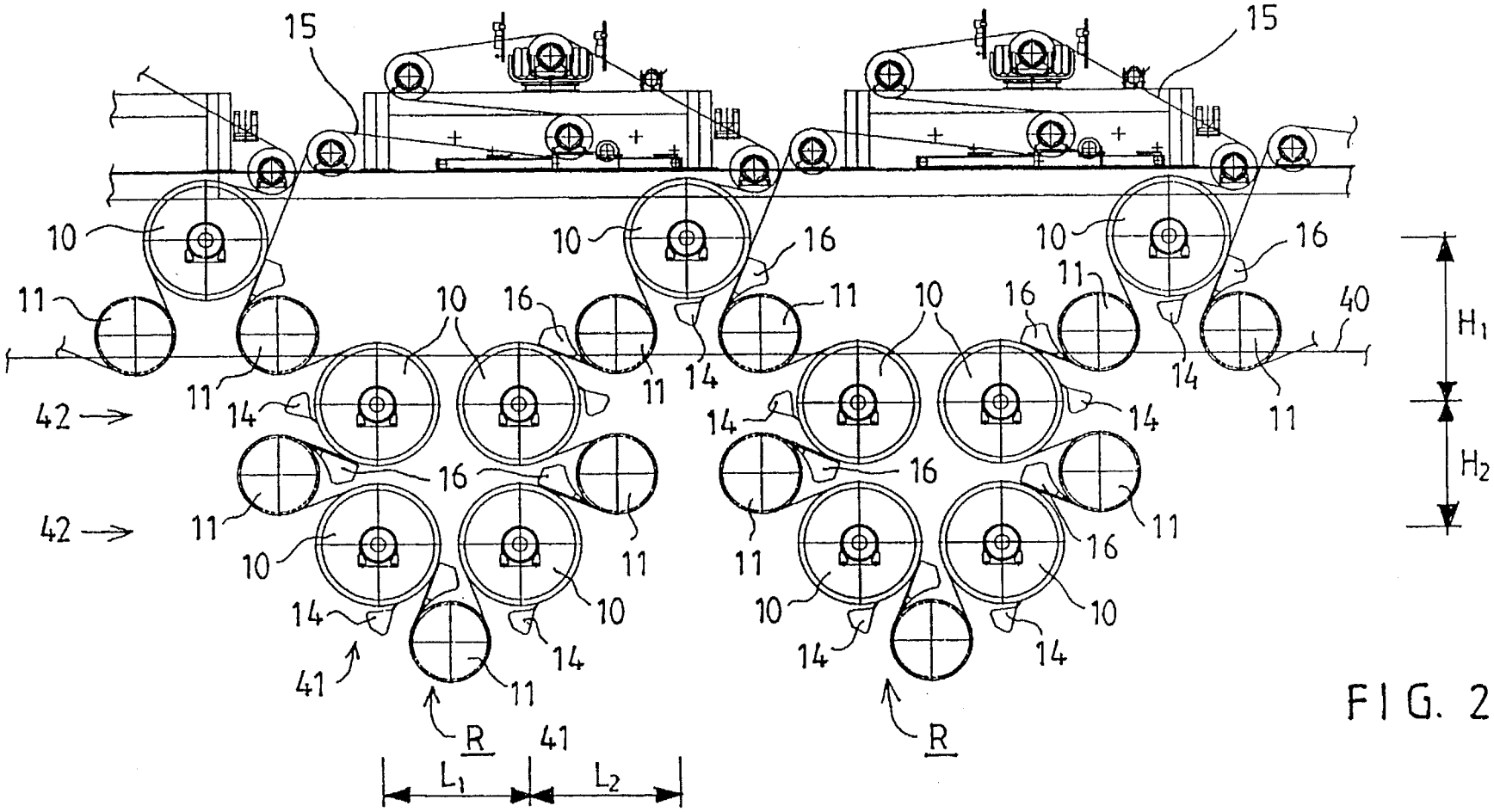
FIG. 2 is a schematic illustration of a second construction of a dryer group used in a dryer section in accordance with the present invention.
Figure 3:
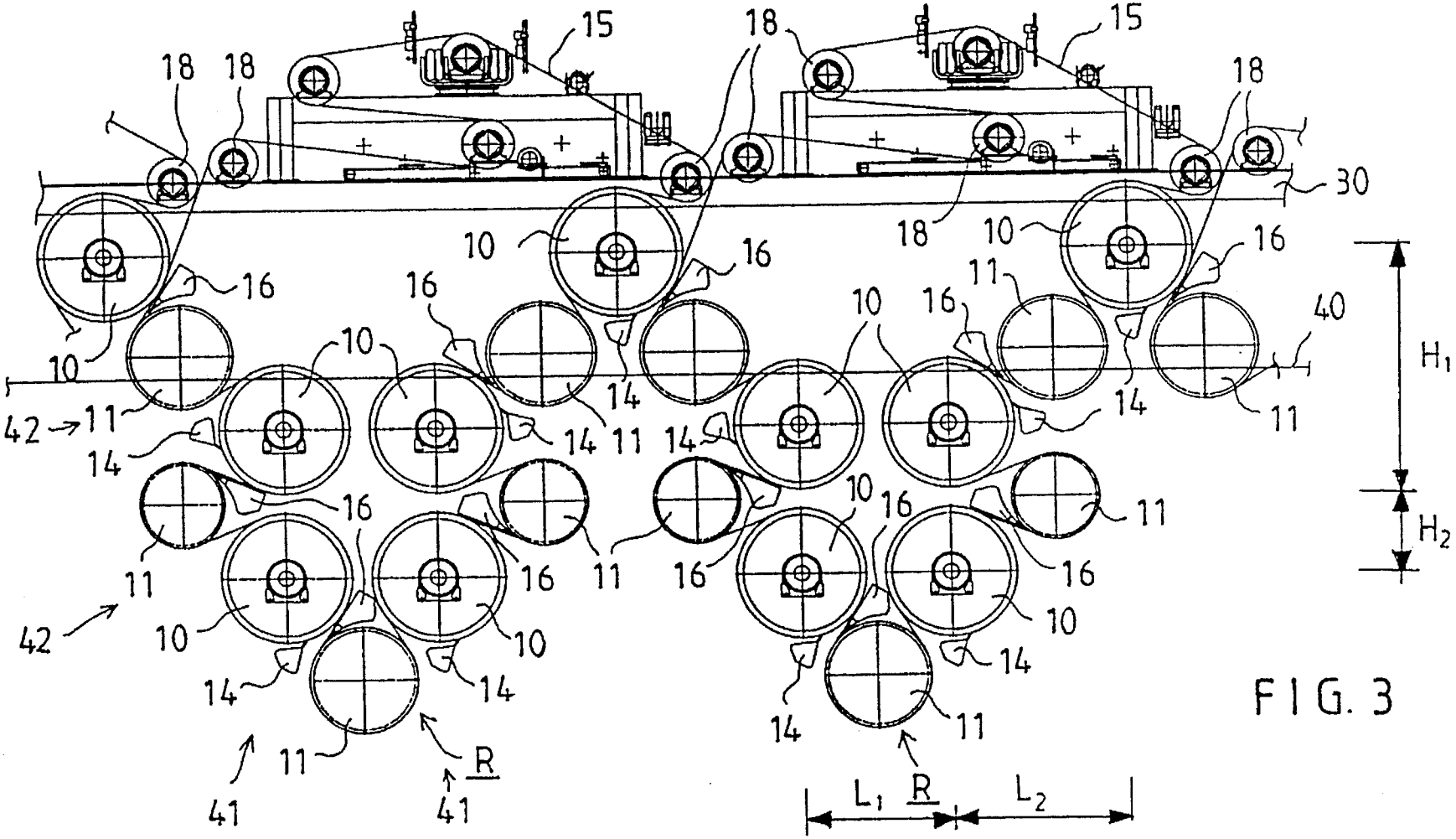
FIG. 3 shows a third dryer-group arrangement for use in a dryer section in accordance with the present invention.

FIG. 3 is substantially similar to the exemplifying embodiment shown in FIG. 2, but the reversing cylinders 11, preferably Vac Rolls, placed on the tending platform 40 and so also the lowest reversing roll 11 have diameters larger than those of the other reversing rolls which larger diameters are about 1000 to about 1800 mm, preferably from about 1500 mm to about 1800 mm, in which case larger drying-cylinder 10 covering angles are obtained and, thereby, better drying capacity. The diameters of the reversing cylinders 11 placed on the intermediate level are from about 600 mm to about 1200 mm, preferably about 1200 mm, in which case a favorable doctor-removing arrangement is obtained. This exemplifying embodiment, i.e. the use of reversing cylinders 11 of different sizes in the same dryer group R, can also be applied to the embodiment of the invention shown in FIG. 1. The differences in height and distance between the cylinder rows 42/41 are as follows: $H_1$ is from about 1.5 m to about 3.5 m, preferably from about 2.2 m to about 3.0 m, $H_2$ is from about 1.6 m to about 2.7 m, preferably from about 1.9 m to about 2.5 m, $L_1$ is from about 1.6 m to about 2.7 m, preferably from about 1.9 m to about 2.5 m, and $L_2$ is from about 1.2 m to about 2.7 m, preferably from about 1.6 m to about 2.4 m.

Figure 4:
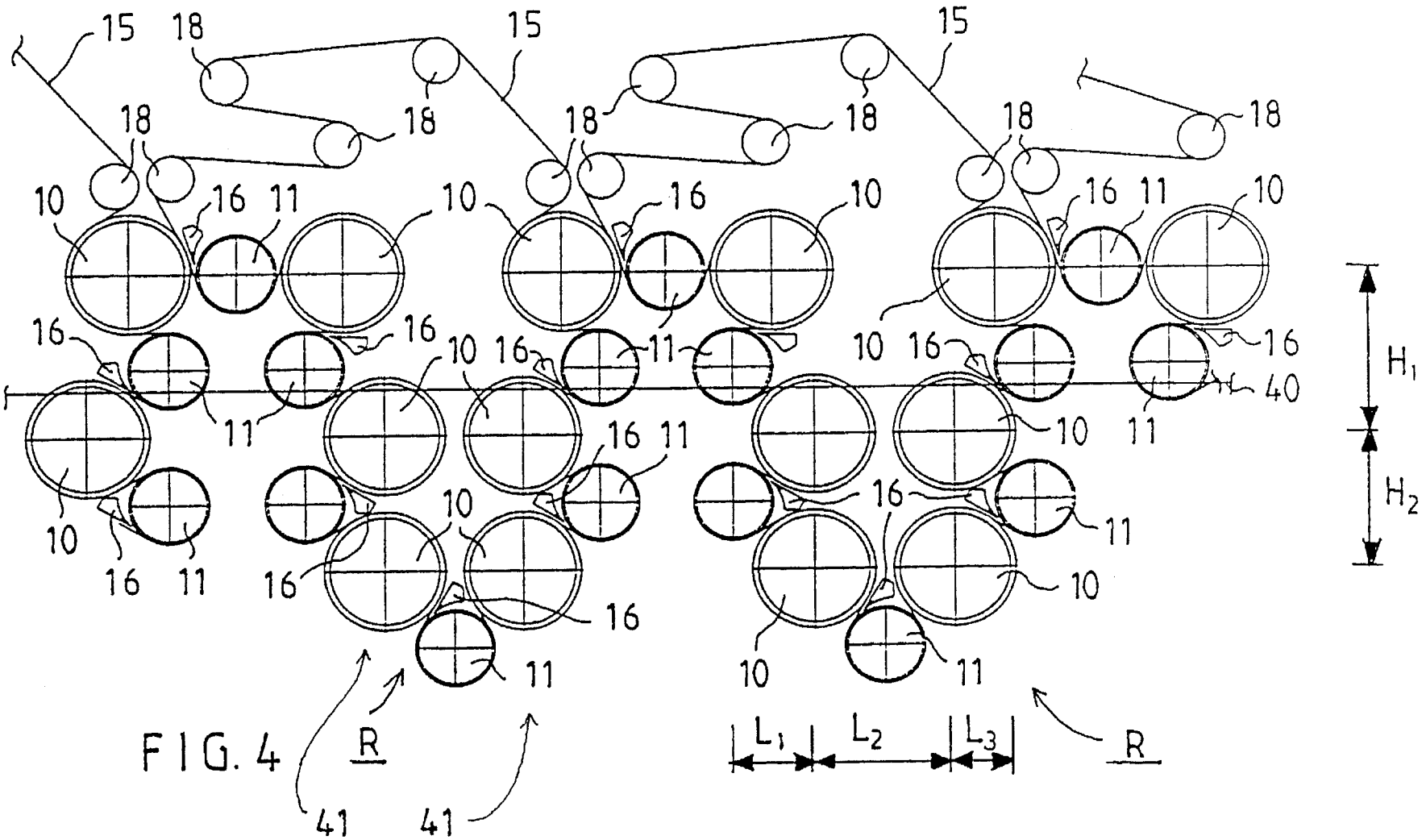
FIG. 4 is a schematic illustration of a further exemplifying embodiment of a dryer group for use in a dryer section in accordance with the present invention.

FIG. 4 shows a dryer-group arrangement in which the four downstairs cylinders 10 are placed in pairs one below the other, and in the upper row, on the tending platform 40 or substantially at the level thereof, in the horizontal direction, there are two drying cylinders 10, the first cylinder and the last cylinder in the group R. The paper web W is brought from the last drying cylinder of the preceding group R onto the first reversing cylinder 11 of the next group as a closed draw. Also in connection with the solution illustrated in this embodiment, it is possible to use the arrangement described in relation to the preceding figure, in which the diameters of the reversing rolls 11 are different. The differences in height and distance between the cylinder rows 42/41 are as follows: $H_1$ is from about 1.5 m to about 3.7 m, preferably from about 2.2 to about 3.2 m, $H_2$ is from about 1.6 m to about 2.7 m, preferably from about 1.9 m to about 2.5 m, $L_1$ is from about 1.6 m to about 2.7 m, preferably from about 1.9 to about 2.7 m, $L_2$ is from about 0.0 m to about 1.2 m, preferably from about 0.5 m to about 1.0 m, and $L_3$ is from about 2.2 m to about 4.5 m, preferably from about 3.0 m to about 4.0 m.

Figure 5:
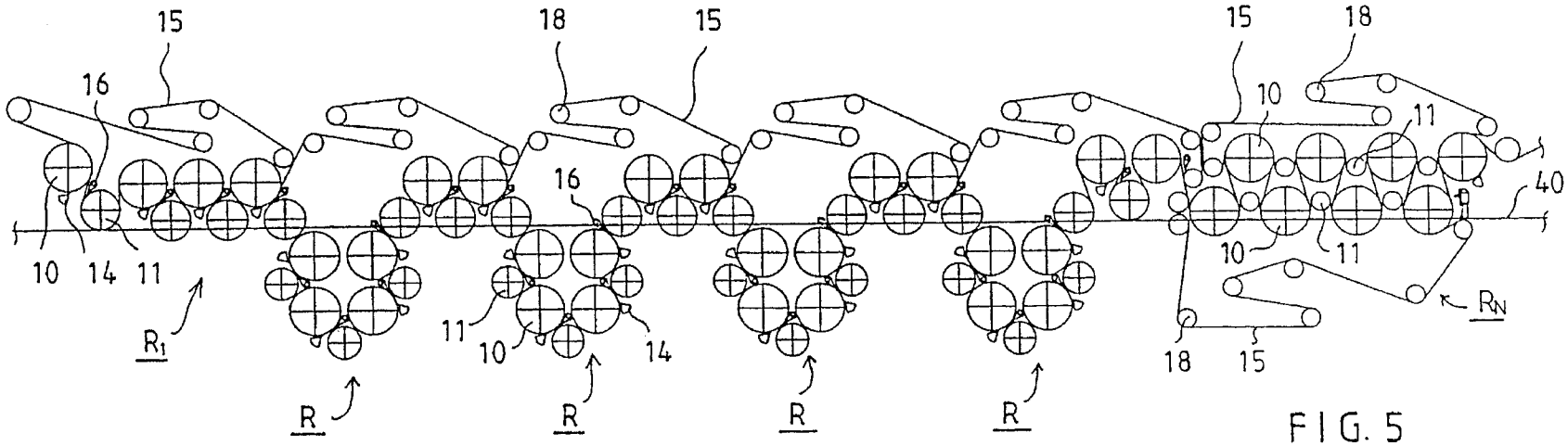
FIG. 5 is a schematic illustration of an exemplifying embodiment of a dryer section in accordance with the present invention.

FIG. 5 shows an exemplifying embodiment of a dryer group as shown in FIG. 1, in which, with the exception of the first short group $R_1$, a conventional portion with single-wire draw has been substituted for by groups R in accordance with the invention, and at the end, as the last dryer group, in view of securing a drying from both sides, there is a group $R_N$ with twin-wire draw. The "short" group $R_1$ has only about 4 drying cylinders. By means of this arrangement, compared with a conventional normal dryer section consisting only of groups with single-wire draw, an overall shortening of about 20% to about 22% of the length of the dryer section is achieved. In the arrangement illustrated here, there are "large" reversing rolls 11 on the tending platform 40.

Figure 6:
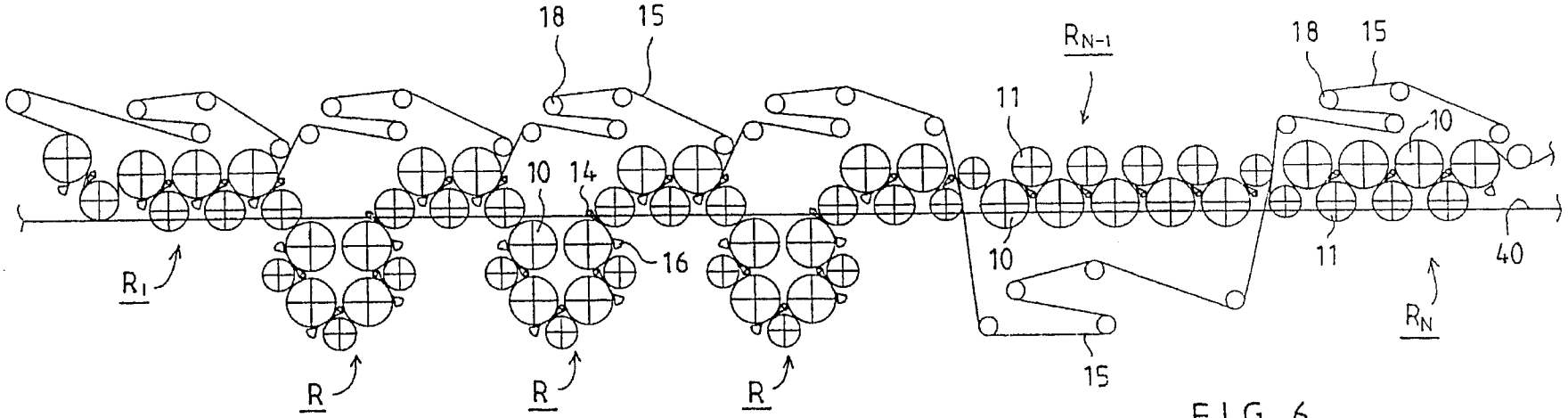
FIG. 6 shows a second exemplifying embodiment of a dryer section in accordance with the present invention.

FIG. 6 shows an embodiment consisting of dryer groups as shown in FIG. 1, in which the first group $R_1$ is a short group that applies a conventional normal single-wire draw, which group $R_1$ is followed by groups R in accordance with the invention, and in which, in view of securing a drying of the web W from both sides, an inverted group $R_{N-1}$ is arranged as the second last dryer group in the dryer section and a normal group $R_N$ with single-wire draw is arranged as the last group in the dryer section. By means of this arrangement, a shortening of about 16% to about 18% is achieved relative to the conventional dryer section having only single-wire draw dryer groups. The inverted group $R_{N-1}$ has the drying cylinders in the lower row and the reversing cylinders in an upper row above the lower row and functions to dry an opposite side of the web as in the normal dryer groups.

Figure 7:
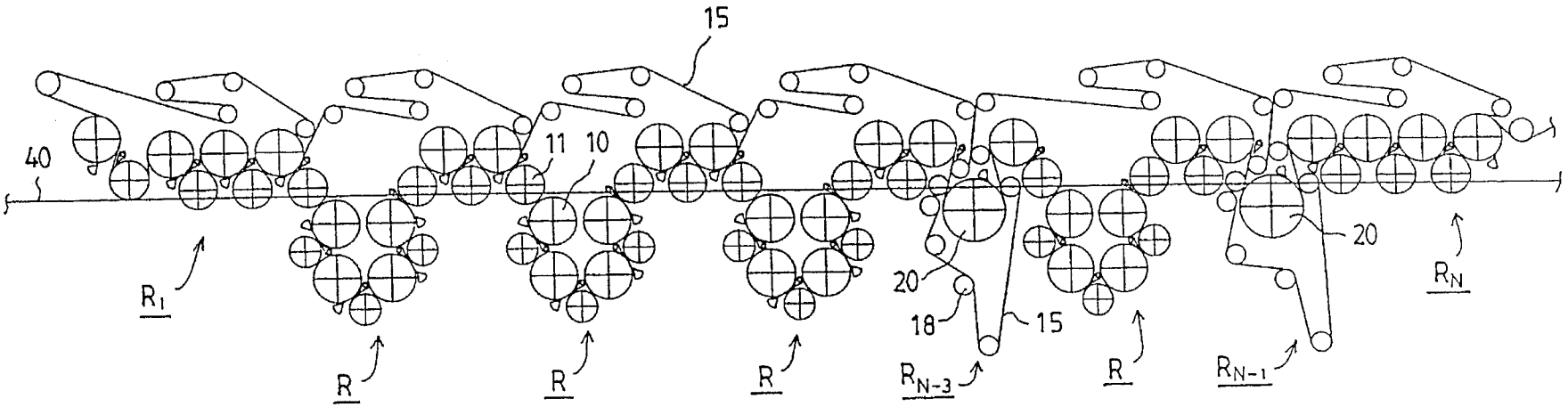
FIG. 7 shows a further exemplifying embodiment of a dryer section in accordance with the present invention.

FIG. 7 shows an exemplifying embodiment of the arrangement as shown in FIG. 1, in which arrangement dryer groups R in accordance with the invention have been combined with so-called group-gap large cylinders 20, by whose means a drying from both sides is secured, and in which the last group $R_N$ is a normal group with single-wire draw. By means of this arrangement, a dryer section is obtained that is about 25% to about 30% shorter than a conventional dryer section that makes use of single-wire draw alone. The groups $R_{N-3}$, $R_{N-1}$ with large cylinders have wire circulations of their own which are guided by wire guide rolls.

Figure 8:
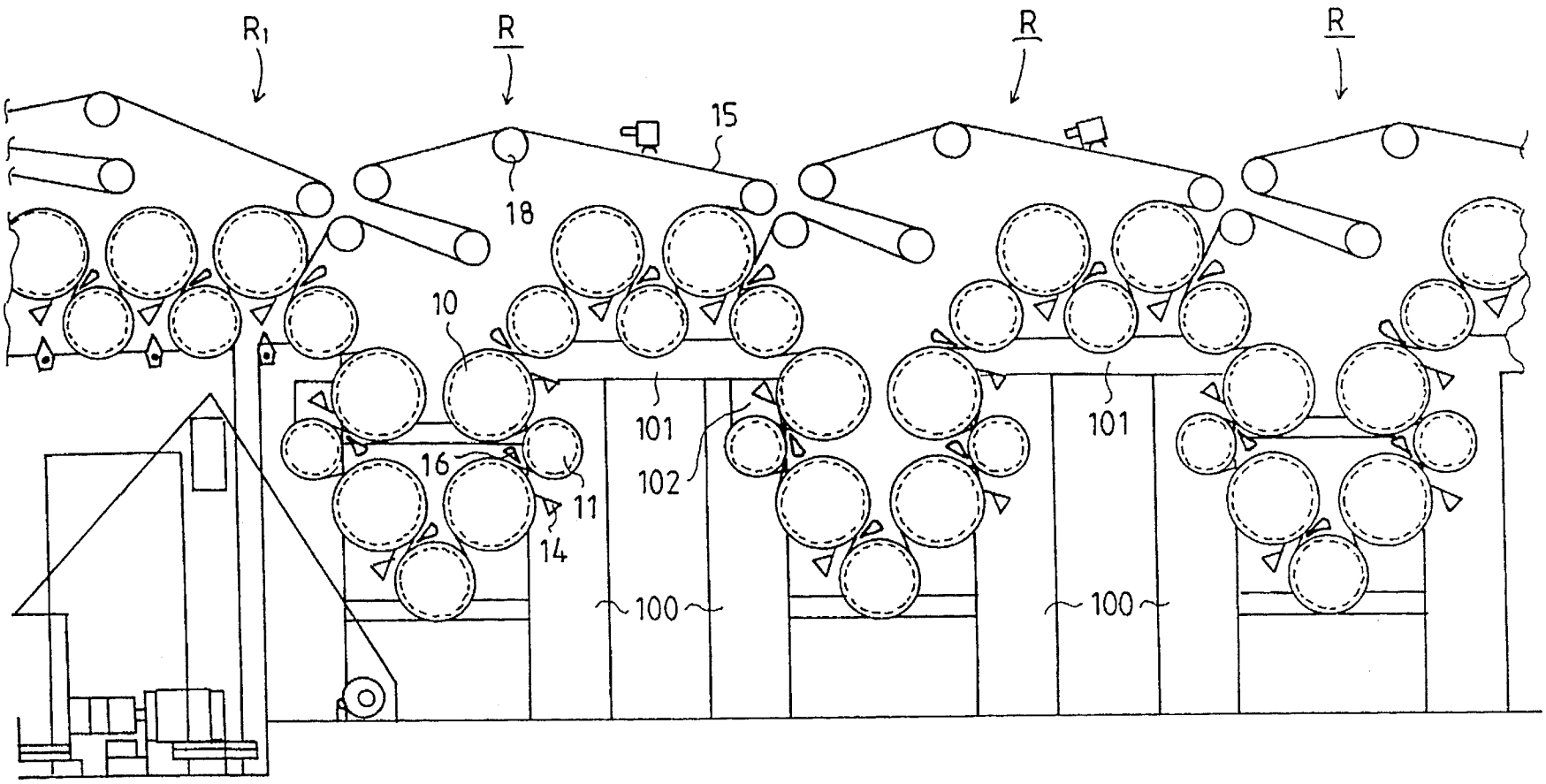
FIG. 8 shows a part of a dryer section composed of dryer groups shown in FIG. 1.

FIG. 8 shows an arrangement in which the frame arrangements for the exemplifying embodiment as shown in FIG. 1 are shown, consisting of vertical beams 100, horizontal beams 101, and auxiliary beams 102 for the reversing rolls 11.

The examples provided above are not meant to be exclusive. Many other variations of the present invention would be obvious to those skilled in the art, and are contemplated to be within the scope of the appended claims. For example, although only four drying cylinders are shown in the cylinder arrangement situated below the tending platform, it is understood that the four cylinders might be arranged at a different position with respect to the tending platform, and that the arrangement may include more than four cylinders arranged in the rows.

We claim:

1. A dryer section for a paper machine, comprising a plurality of dryer groups with single-wire draw, each of said single-wire draw groups including drying cylinders, reversing cylinders arranged in gaps between adjacent ones of said drying cylinders, and a drying wire for carrying a web into direct contact with outer surfaces of said drying cylinders and such that the drying wire is situated between the web and outer surfaces of said reversing cylinders, at least one of said single-wire draw groups comprising four drying cylinders, first and second ones of said four cylinders being arranged in a first horizontal level and third and fourth ones of said four cylinders being arranged in a second horizontal level above said first horizontal level such that the axes of said first and said third cylinders are situated in a first common substantially vertical column and the axes of said second and said fourth cylinders are situated in a second common substantially vertical column, the web-carrying wire running over said fourth drying cylinder after running over said first, second and third drying cylinders, and at least one additional drying cylinder arranged at a horizontal level above said second horizontal level and after said fourth drying cylinder in a running direction of the web-carrying wire, a first one of said at least one additional drying cylinder being arranged adjacent said fourth drying cylinder without any of said drying cylinders being interposed between said fourth drying cylinder and said first additional drying cylinder, said first additional drying cylinder having an axis horizontally spaced from said second substantially vertical column, the web-carrying wire running from said fourth drying cylinder to said adjacent first additional drying cylinder over a single one of said reversing cylinders.

2. The dryer section of claim 1, further comprising a tending platform, said four drying cylinders being arranged below said tending platform, said at least one additional drying cylinder being arranged substantially at the level of said tending platform.

3. The dryer section of claim 1, wherein said at least one additional drying cylinder comprises a pair of drying cylinders, further comprising a tending platform, said pair of drying cylinders being arranged adjacent one another substantially at the level of said tending platform and after said first, second, third and fourth drying cylinders in a running direction of the drying wire at an end of said at least one single-wire draw group.

4. The dryer section of claim 1, wherein said at least one additional drying cylinder comprises a pair of drying cylinders, further comprising a tending platform, said pair of drying cylinders being arranged substantially at the level of said tending platform, said first, second, third and fourth drying cylinders are situated between a first one of said pair of drying cylinders and a second one of said pair of drying cylinders.

5. The dryer section of claim 1, wherein said first, second, third and fourth drying cylinders are arranged such that their respective center of rotation are placed at a corner point of a rectangle.

6. The dryer section of claim 1, wherein said first, second, third and fourth drying cylinders are arranged such that their respective center of rotation are placed at a corner point of a square.

7. The dryer section of claim 5, wherein said reversing cylinders are arranged in gaps between said first, second, third and fourth drying cylinders outside of said rectangle defined by the centers of rotation of said first, second, third and fourth drying cylinders.

8. The dryer section of claim 1, wherein said reversing cylinders in said at least one of said single-wire draw groups have different diameters.

9. The dryer section of claim 2, wherein a portion of said reversing cylinders are arranged above said tending platform, said portion of reversing cylinders arranged above said tending platform having a larger diameter than said reversing cylinders arranged at the level of said tending platform and below said tending platform.

10. The dryer section of claim 1, wherein a first one of said dryer groups in a running direction of the web constitutes a short normal dryer group with single-wire draw in which said drying cylinders are arranged in a common horizontal plane, and said at least one of said single-wire draw groups comprises subsequent ones of said dryer groups.

11. The dryer section of claim 1, further comprising a dryer group with twin-wire draw as a last group in the dryer section in the running direction of the web.

12. The dryer section of claim 1, further comprising a plurality of said single-wire draw groups comprising four drying cylinders, first and second ones of said four cylinders being arranged in a first horizontal level and third and fourth ones of said four cylinders being arranged in a second horizontal level above said first horizontal level such that the axes of said first and said third cylinders are situated in a first common substantially vertical column and the axes of said secondhand said fourth cylinders are situated in a second common substantially vertical column, and at least one additional drying cylinder arranged at a horizontal level above said second horizontal level, and an inverted group with single-wire draw including drying cylinders arranged in a first row, reversing cylinders arranged in gaps between adjacent ones of said drying cylinders and in a second row above said first row, and a drying wire for carrying a web into direct contact with outer surfaces of said drying cylinders and such that the drying wire is situated between the web and outer surfaces of said reversing cylinders.

13. The dryer section of claim 1, further comprising a group-gap large cylinder arranged in at least one group gap defined between adjacent ones of said dryer groups.

14. The dryer section of claim 1, wherein only one of said reversing cylinders is arranged in each of said gaps between adjacent ones of said four drying cylinders in said at least one single-wire draw group, each of said reversing cylinders being positioned at a location between said adjacent ones of said four drying cylinders.

15. A dryer section for a paper machine, comprising a plurality of dryer groups with single-wire draw, each of said single-wire draw groups including drying cylinders, reversing cylinders arranged in gaps between adjacent ones of said drying cylinders, and a drying wire for carrying a web into direct contact with outer surfaces of said drying cylinders and such that the drying wire is situated between the web and outer surfaces of said reversing cylinders, at least one of said single-wire draw groups consisting of first, second, third and fourth drying cylinders, said first and said second drying cylinders being arranged in a first horizontal level and said third and said fourth drying cylinders being arranged in a second horizontal level above said first horizontal level such that the axes of said first and said third drying cylinders are situated in a first common substantially vertical column and the axes of said second and said fourth drying cylinders are situated in a second common substantially vertical column, and a fifth cylinder arranged at a horizontal level above said second horizontal level, wherein only one of said reversing cylinders is arranged in each of said gaps between adjacent ones of said first, second, third, fourth and fifth drying cylinders and in a position between said adjacent ones of said drying cylinders.

16. The dryer section of claim 15, wherein said fifth drying cylinder is arranged after said fourth drying cylinder in a running direction of the wire without any of said drying cylinders being interposed between said fourth drying cylinder and said fifth drying cylinder, said fifth drying cylinder being arranged such that its axis is horizontally spaced from said second substantially vertical column.

17. A dryer section for a paper machine, comprising a plurality of dryer groups with single-wire draw, each of said single-wire draw groups including drying cylinders, reversing cylinders arranged in gaps between adjacent ones of said drying cylinders, and a drying wire for carrying a web into direct contact with outer surfaces of said drying cylinders and such that the drying wire is situated between the web and outer surfaces of said reversing cylinders, at least one of said single-wire draw groups comprising four drying cylinders, first and second ones of said four cylinders being arranged in a first horizontal level and third and fourth ones of said four cylinders being arranged in a second horizontal level above said first horizontal level such that the axes of said first and said third cylinders are situated in a first common substantially vertical column and the axes of said second and said fourth cylinders are situated in a second common substantially vertical column, and at least one additional drying cylinder arranged at a horizontal level above said second horizontal level, and a tending platform, said four drying cylinders being arranged below said tending platform, said at least one additional drying cylinder being arranged substantially at the level of said tending platform, a portion of said reversing cylinders being arranged above said tending platform, said portion of said reversing cylinders arranged above said tending platform having a larger diameter than said reversing cylinders arranged at the level of said tending platform and below said tending platform.

* * * * *